United States Patent [19]

Nagano

[11] Patent Number: 4,623,317

[45] Date of Patent: Nov. 18, 1986

[54] METAMORPHIC RADIO-CONTROLLED TRAVELING TOY

[75] Inventor: Toshiaki Nagano, Mibu, Japan

[73] Assignee: Shinsei Kogyo Co., Ltd., Tokyo, Japan

[21] Appl. No.: 731,776

[22] Filed: May 8, 1985

[30] Foreign Application Priority Data

May 9, 1984 [JP] Japan ..... 59-67683[U]
May 9, 1984 [JP] Japan ..... 59-67684[U]

[51] Int. Cl.[4] ..... A63H 11/10

[52] U.S. Cl. ..... 446/289; 446/378; 446/487

[58] Field of Search ..... 403/93, 96, 59; 446/376, 378, 487, 489, 289, 288, 290, 291, 292, 279, 320, 269, 93, 95, 97, 456, 280

[56] References Cited

U.S. PATENT DOCUMENTS

| | | | |
|---|---|---|---|
| 560,907 | 5/1896 | Leger | 446/381 |
| 718,662 | 1/1903 | Shaffer | 446/378 X |
| 4,543,073 | 9/1985 | Matsuda | 446/457 X |

OTHER PUBLICATIONS

Japan, Utility Model 59-8990, Jan. 18, 1984.
Japan, Utility Model 58-145694, Sep. 30, 1983.

*Primary Examiner*—Mickey Yu
*Attorney, Agent, or Firm*—Staas & Halsey

[57] ABSTRACT

A metamorphic radio-controlled traveling toy having a traveling element; a leg element; a torso element; a pair of arm elements; and a head element. The traveling element includes a radio receiving unit and a drive and moving unit. The leg element is pivotably attached to the traveling element such that it can perform standing-up and falling-down shape-changing actions. The torso element is slidably attached to the leg element. The arm elements are slidably and rotatably attached to the torso element using cylindrical sleeve-type connecting mechanisms for providing different stop positions of the arm elements during rotational movement and for providing sliding movement of the arm elements away from and to the torso element. The head element is slidably attached to the torso element such that it can be embedded in the torso element in one position and extended from the torso in another position. In the preferred embodiment, the above elements in a closed lowered position form the exterior configuration of a toy vehicle, such as a car or truck, while in another open raised position form the configuration of a robot. The toy can be radio-controlled to operate and travel in the different configurational positions.

13 Claims, 12 Drawing Figures

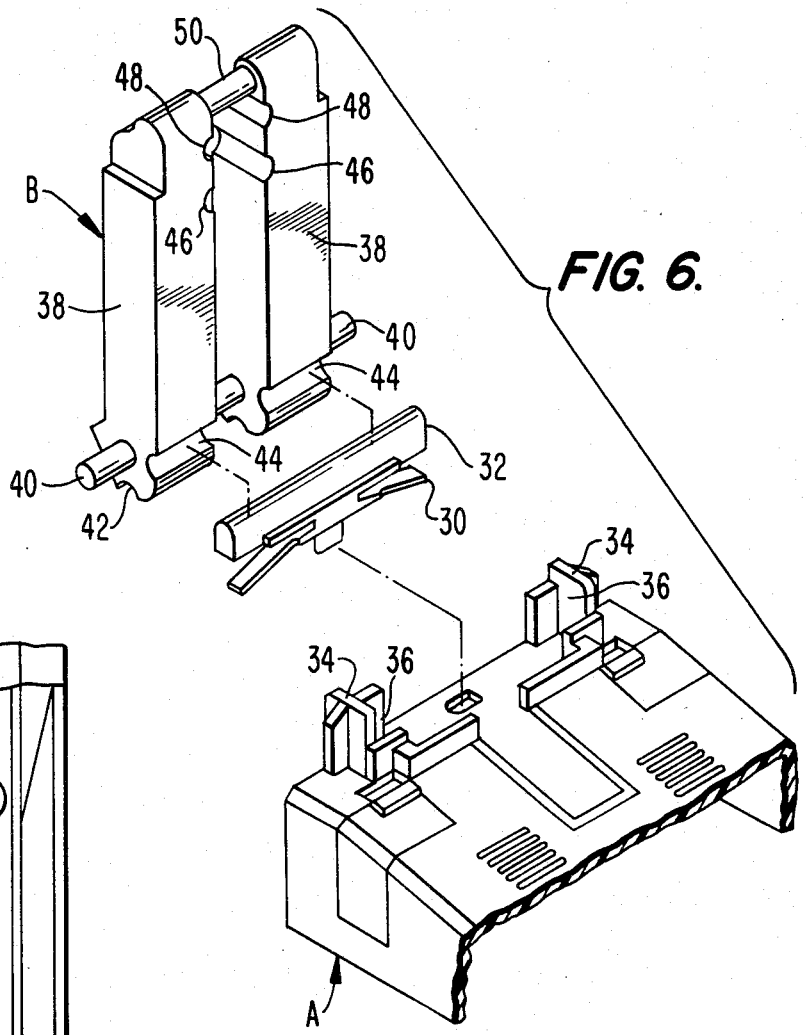
FIG. 6.
FIG. 7.
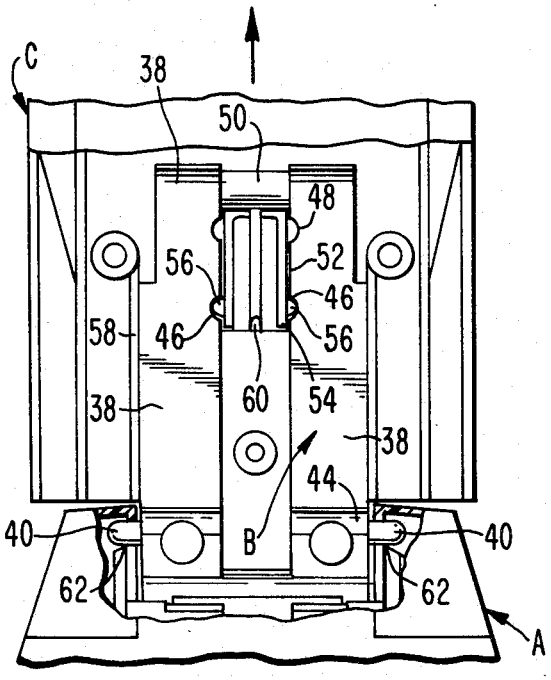
FIG. 11.
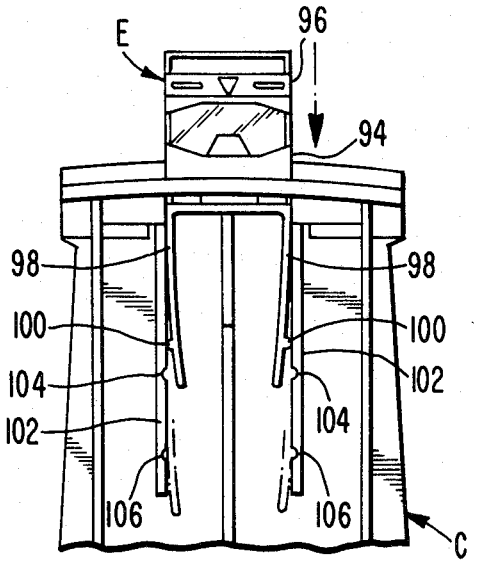

METAMORPHIC RADIO-CONTROLLED TRAVELING TOY

BACKGROUND OF THE INVENTION

This invention relates to a traveling toy, and more particularly, to a metamorphic radio-controlled traveling toy.

Remote-controlled traveling toys and metamorphic traveling toys are known and are popular with users of different age levels. However, the challenge is to provide a traveling toy which can best capture the interest of the user, maintain that interest for the longest play time, entertain users of all different age levels, is simple to operate, is durable for a prolonged life of the toy, is simple in structure to provide a low-cost, mass-produced toy, is easily and smoothly operated in varied configurational positions, and is easy to change configurations of the toy between different positions therefor.

SUMMARY OF THE INVENTION

Accordingly, a primary object of this invention is to provide a traveling toy which is both remote controlled and which can be adapted to change between different configurations, thereby capturing the appeal and interest of the user and maintaining that interest for reasonable periods of play time.

Yet another object of this invention is to provide a metamorphic radio-controlled traveling toy which can be easily operated and run smoothly in all of its different configurational positions.

A further object of this invention is to provide a metamorphic radio-controlled traveling toy with the features set forth above, wherein the shape-changing actions can be performed easily and smoothly by the user between the varied configurational positions of the toy.

Another object of this invention is to provide a metamorphic radio-controlled traveling toy with the features set forth above which is simple in operation.

Still another object of this invention is to provide a metamorphic radio-controlled traveling toy with the features set forth above which is durable for a prolonged life of the toy.

Yet another object of this invention is to provide a metamorphic radio-controlled traveling toy with the features set forth above, wherein the toy parts are movably yet fixedly attached to each other, thus avoiding separation and loss of the toy parts.

Another object of this invention is to provide a metamorphic radio-controlled traveling toy with the features set forth above which is simple in mechanical structure and electrical arrangement to provide a relatively inexpensively manufactured toy of this type.

Additional objects and advantages of the invention will be set forth in part in the description which follows, and in part will be obvious from the description, or may be learned by practice of the invention.

To achieve the foregoing objects and in accordance with one aspect of the invention, as embodied and broadly described herein, there is provided a metamorphic radio-controlled traveling toy comprising:

(a) a traveling element, including a radio signal receiving unit for receiving control signals from a remote radio control transmitter and drive and moving means for driving and moving the toy in response to the radio signals received by said radio receiving unit;

(b) a leg element pivotably attached to the traveling element such that the leg element can be lowered and raised in relationship to the traveling element for different configurational positions of the toy;

(c) a torso element slidably attached to the leg element such that the torso element can be moved in relationship to the leg element for different configurational positions of the toy;

(d) arm elements slidably and rotatably attached to the torso element such that the arm elements can be moved in relationship to the torso element for different configurational positions of the toy; and (e) a head element slidably attached to the torso element such that the head element can be moved into the torso element and extended from the torso element for different configurational positions of the toy.

In the preferred embodiment of the traveling toy, in one configurational position, i.e., a closed lowered position, the above elements form the exterior configuration of a toy vehicle, such as a car or truck; in another configurational position, i.e., an open upright position, the above elements form the exterior configuration of a robot. In the closed lowered position of the toy, the arm elements, torso element, and head element form different but integral parts of the exterior of the vehicle. In the lowered vehicular configurational position, the arm elements also can be extended horizontally outwardly from the toy vehicle to form a configuration for capturing a ball or the like moving it along the ground. The toy of this invention is radio-controlled to operate and travel in its different configurational positions. The aforesaid leg, torso, arm and head elements of the toy of this invention are all movably attached to each other so that there is no separation of the toy parts during the changing between the external configurations.

In another aspect of the invention, the arm elements are slidably and rotatably attached to the torso element using cylindrical sleeve-type connecting mechanisms for providing different stop positions of the arm elements during rotational movement and for providing sliding movement of the arm elements away from and to the torso element. This connecting mechanism provides an easy and smooth sliding movement of the arm elements with positive rotational stop positions in a simple sturdy mechanical connecting arrangement.

Finally and in accordance with another aspect of the invention, as embodied and broadly described herein, there is provided a connecting device for connecting a moveable element to a fixed element in a metamorphic toy comprising (a) a fixed body; (b) a moveable body having an arm shaft; (c) a piece-receiving means having a substantially cylindrical piece slidably and rotatably, said piece-receiving means being mounted to the fixed body and having elastic elements, each elastic element being formed by a substantially U-shaped cut-out in the circumference wall of the cylindrical housing and having an engaging projection directed toward a center of the piecereceiving cylindrical housing; and (d) a substantially cylindrical-shaped piece having one end fixed to an end of the arm shaft of the moveable body, and having a plurality of projection pass-through grooves transversely along the outer cylindrical circumference of the piece for allowing said engaging projections of said elastic elements to pass therethrough, projection pass-through cut-outs at the peripheral edges of the piece for connecting end portions of the projection pass-through grooves, and engaging recesses formed at the intersections of the ends of said grooves and cutouts deeper than said grooves and said cut-outs, said recesses being engageable and disengageable with said engaging projections of said elastic elements in accordance with the rotational position and slidable position of the moveable body to the fixed body.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 6 is an exploded fragmentary perspective view of the mounting mechanism for pivotably mounting the leg elements to the traveling element of the toy of FIG. 1;

FIG. 7 is a plan view of the internal connecting mechanism for slidably connecting the leg element to the torso element of the toy of FIG. 1;

FIG. 11 is a front fragmentary view of the mounting means for slidably connecting the head element to the torso element of the toy of FIG. 1.

DETAILED DESCRIPTION OF THE PREFERRED EMBODIMENTS

In accordance with the invention, and as described in the preferred embodiments below, the metamorphic radio-controlled traveling toy comprises the general construction of a traveling element A; a leg element B; a torso element C; a pair of arm elements D; and a head element E. Each of the above elements is movably attached to other elements of the toy and when moved in different positions creates different configurations for the toy.

Figure 1:
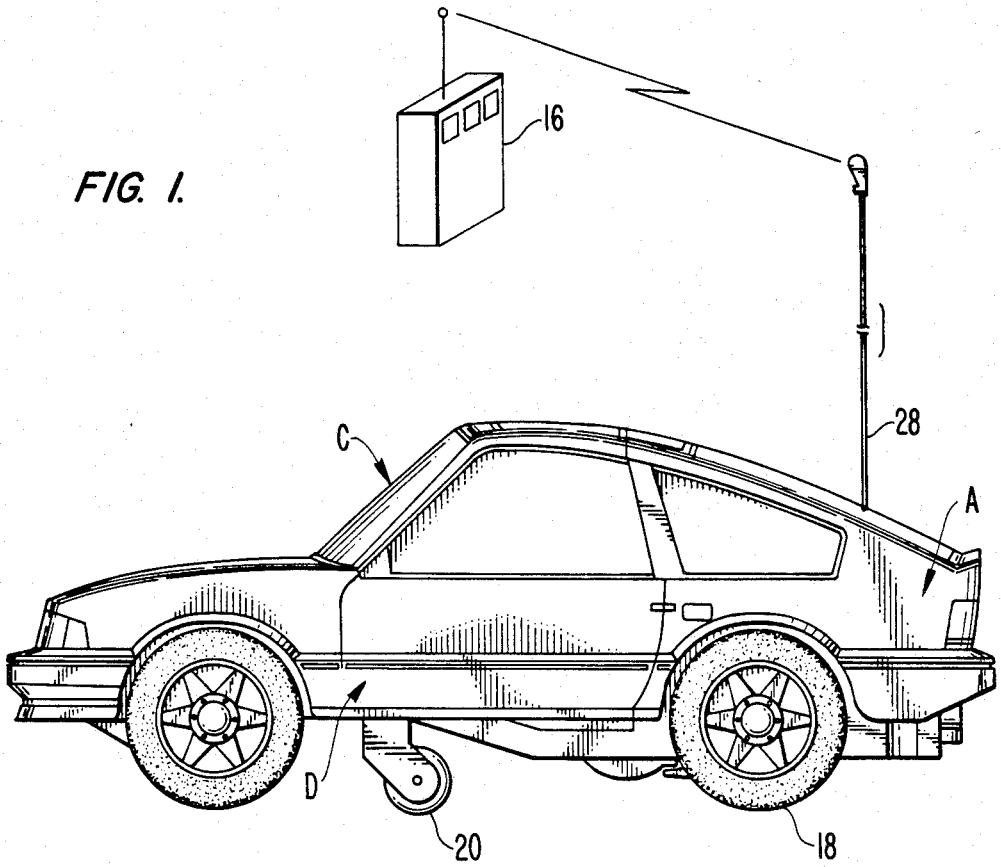
FIG. 1 is a side view of a preferred embodiment of the metamorphic radio-controlled traveling toy of the present invention, wherein the toy is in a closed lowered position having the external configuration resembling an automobile.

As best seen with reference to FIG. 1, in a closed lowered position of the toy elements, the toy resembles the exterior configuration of an automobile, with the traveling element forming the rear body portion of the automobile, the torso element C forming the front top body portion of the automobile, the pair of arm elements D forming the front side body portions of the automobile, and the head element E forming a portion of the front bumper of the automobile.

Figure 12:
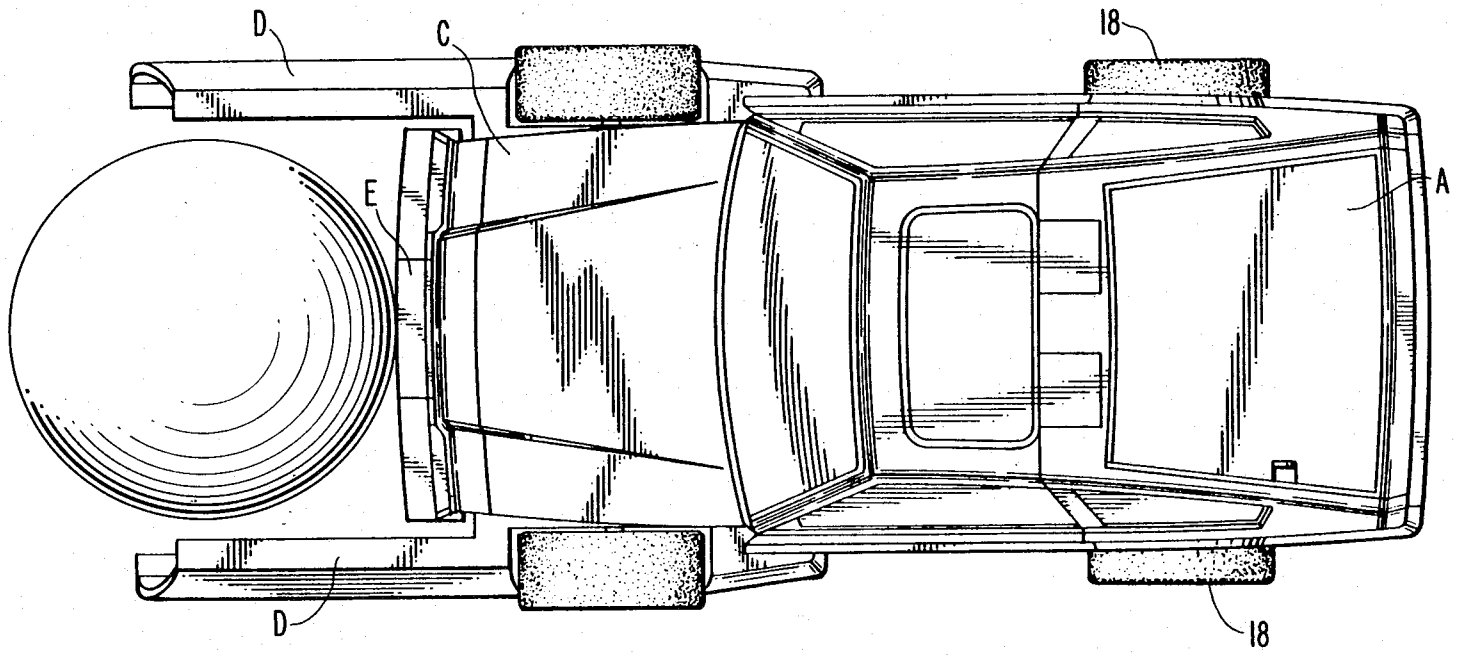
FIG. 12 is a top plan view of the toy of FIG. 1, illustrating in particular the lowered vehicular configurational position but with the arm elements extending in front of the toy for capturing and moving a ball or the like along the ground.

In yet a modified lowered vehicular configuration, as best seen in FIG. 12, the toy has the pair of arm elements D positioned horizontally but extending from the torso element C from the front of the automobile in such a manner to be able to capture a ball or the like and move that ball along the ground during travel of the toy.

Figure 2:
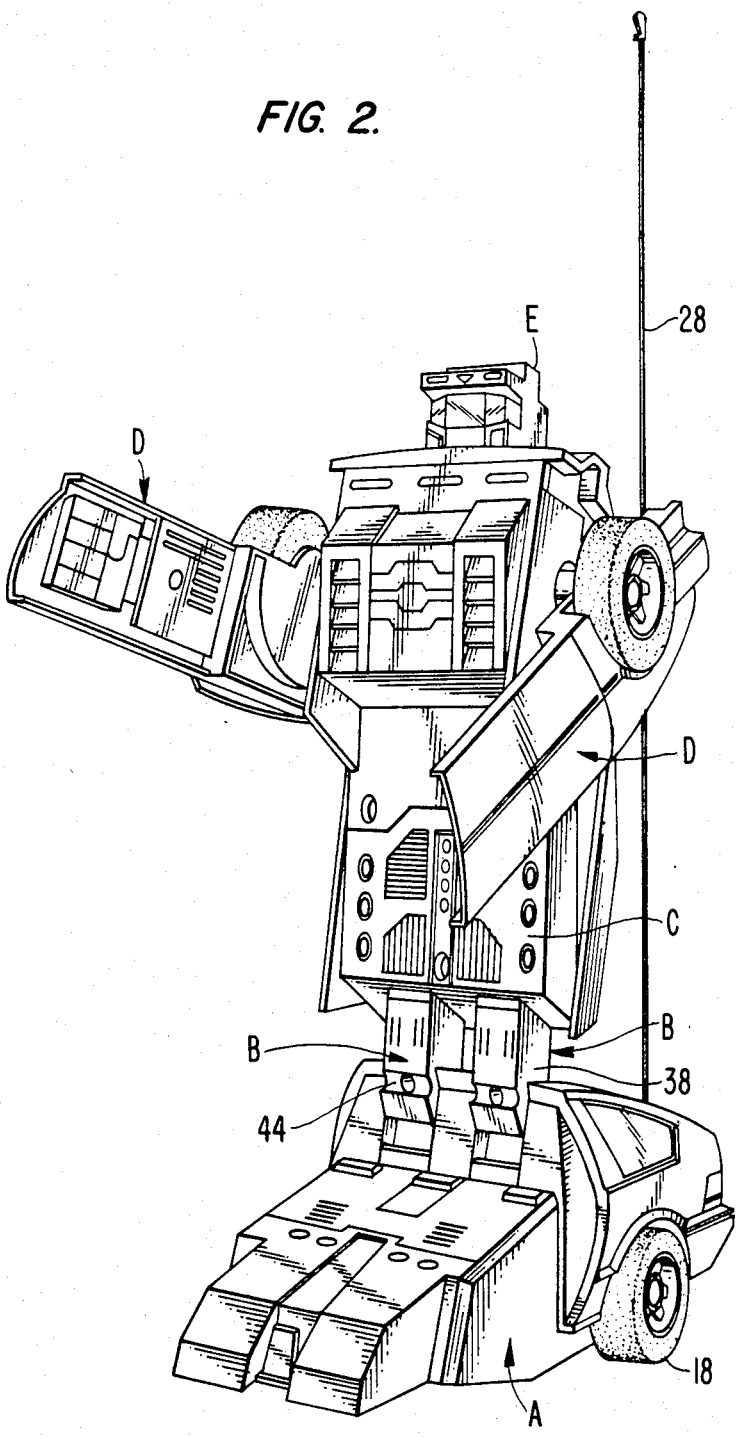
FIG. 2 is a perspective view of the metamorphic radio-controlled traveling toy of FIG. 1, wherein the toy is in an open raised position having the external configuration resembling a robot.

In an open raised position for the elements of the toy, as best seen in FIG. 2, the toy resembles a robot, with the traveling element A forming the base portion, the leg element B raised and extending upwardly from the traveling element A, the torso element extending upwardly from the leg element B, the arm elements D extending away from the torso element C and rotatably movable in relationship thereto, and the head element E extending upwardly from the torso element C.

In all of the above configurations, the traveling toy embodied herein can be operated and moved in its different configurational positions. More particularly, the toy can be operated by radio control by the user using a remote radio control transmitter 16 provided with appropriate operating buttons for forward and left and right side movements of the vehicle as will be described further below. The traveling element A includes radio signal receiving means for receiving control signals from the remote radio control transmitter and drive and moving means for driving and moving the toy in response to the radio signals received by the radio receiving means as will also be further described below.

With more detailed reference to the drawings, like characters or numerals designate like parts in the views of the drawings as follows: with particular reference to FIGS. 1, 3, 5, and 6, numeral 16 designates a remote radio-controlled transmitter; numeral 18 designates a pair of drive wheels; numeral 20 designates a traveling wheel; numeral 22 designates a pair of drive motors; numeral 24 designates a pair of gear transmission mechanisms connecting the drive motors 22 with corresponding drive wheels 18; numeral 26 designates a radio signal receiving unit 26 for receiving control signals from transmitter 16 and electrically connected to the drive motors 22; numeral 28 designates an antenna connected to radio signal receiving unit 26 for receiving signals from transmitter 16; numeral 30 designates a spring member; numeral 32 designates a pivotably leg mounting and positioning member; numeral 34 designates a pair of guide members; numeral 36 designates a pair of corresponding guide cavities 36 in members 34; numeral 38 designates a pair of leg body members; numeral 40 designates a pair of pivoting leg mounting axles; numeral 42 designates first pivotably mounted leg positioning grooves; numeral 44 designates second pivotably mounted leg positioning grooves; numeral 46 designates first connecting and torso positioning grooves; numeral 48 designates second connecting and torso positioning grooves; and numeral 50 designates a leg guide roller member.

With particular reference to FIG. 7, numeral 52 designates a U-shaped leg and torso connecting and positioning member; numeral 54 designates a pair of spring arms of the U-shaped member 52; numeral 56 designates a pair of torso positioning projections extending from the corresponding spring arms 54; numeral 58 designates a pair of leg guide ribs provided on the internal surface of torso element C; numeral 60 designates a leg stop pin projecting from the internal surface of torso element C; and numeral 62 designates a pair of pivotably mounting leg axle grooves formed on the internal surface of traveling element A.

Figure 8:
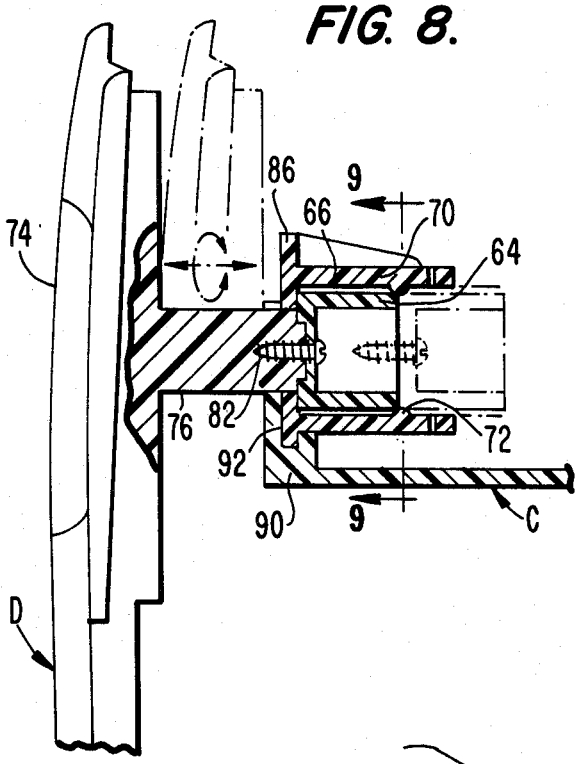
FIG. 8 is a front fragmentary sectional view of the connecting means for slidably and rotatably connecting the arm element to the torso element in the toy of FIG. 1.
Figure 9:
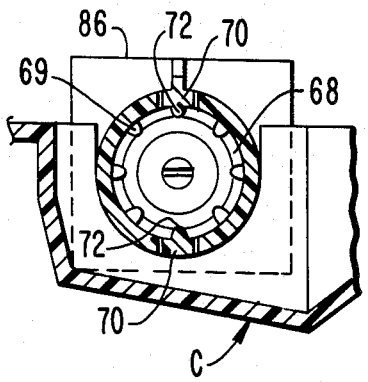
FIG. 9 is a side fragmentary sectional view of the connecting means for connecting the arm element to the torso element in the toy of FIG. 1.
Figure 10:
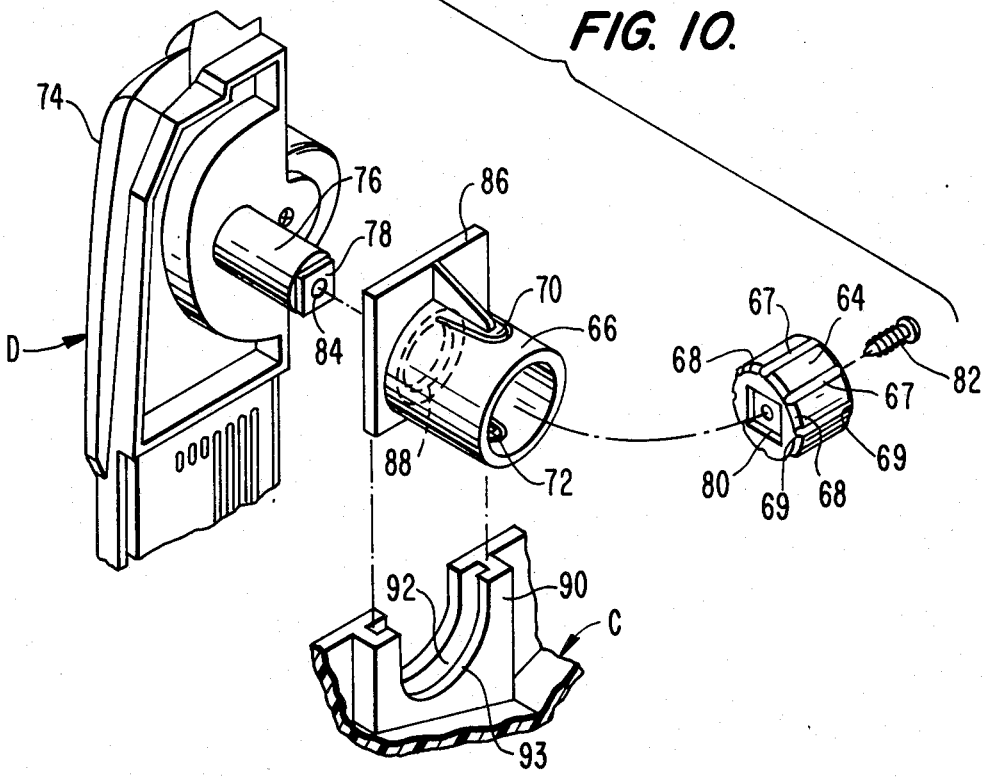
FIG. 10 is an exploded perspective view showing the components comprising the connecting means for connecting the arm element to the torso element in the toy of FIG. 1.

With particular reference to FIGS. 8–10, numeral 64 designates a rotatably and slidable sleeve for connecting an arm element D to torso element C; numeral 66 designates a sleeve housing and support member for rotatably and slidably receiving sleeve 64; numeral 67 designates a plurality of projection pass-through grooves formed on the outer perimeter of sleeve 64; numeral 68 designates cut-outs formed at both peripheral edges of sleeve 64 for connecting the ends of grooves 67; numeral 69 designates projection engaging notches or recesses formed at both ends of pass-through grooves 67; numeral 70 designates a pair of spring-biased positioning members for grooves 67; numeral 72 designates projections formed on the positioning members 70 for engaging positioning grooves 67; numeral 74 designates an arm body member; numeral 76 designates an arm axle connected to arm body member 74; numeral 78 designates a fitting projection member formed at the end of arm axle 76; numeral 80 designates a fitting depression formed at the end of sleeve 64 for receiving fitting projection member 78; numeral 82 designates a sleeve fastening screw member; numeral 84 designates an arm screw hole for receiving screw member 82 and fixably attaching sleeve 64 to arm axle 76; numeral 86 designates a plate-like mounting member for mounting sleeve housing and support member 66 to the torso element C; numeral 88 designates a hole formed in the plate-like mounting member 86 for rotably and slidably receiving arm axle 76; numeral 90 designates a sleeve housing mounting and support member formed on the inside surface of the torso element C; numeral 92 designates a cavity formed in housing and support member 90 for receiving plate-like mounting member 86 therein; and numeral 93 designates cylindrical recesses in the walls formed in the housing and support member 90 for receiving the outer wall of sleeve 64.

With particular reference to FIG. 11, numeral 94 designates a U-shaped head body member slidably received in torso element C; numeral 96 designates an end portion of body member 94 forming the head element E; numeral 98 designates a pair of spring-like connecting and positioning arms of member 94 slidably received in torso element C; numeral 100 designates a pair of head positioning projections formed on spring arms 98; numeral 102 designates guide ribs formed on the internal surface of the torso element C for slidably receiving body member 94; numeral 104 designates a pair of first head positioning grooves formed in guide ribs 102 for receiving corresponding projections 100 of body member 94; and numeral 106 designates a pair of second head positioning grooves formed in guide ribs 102 for receiving corresponding positioning projections 100 of body member 94.

With the foregoing description of the different components for the traveling toy in accordance with the preferred embodiments of the invention, it can be readily seen how the structure of the toy is now arranged and the operation thereof implemented.

Figure 3:
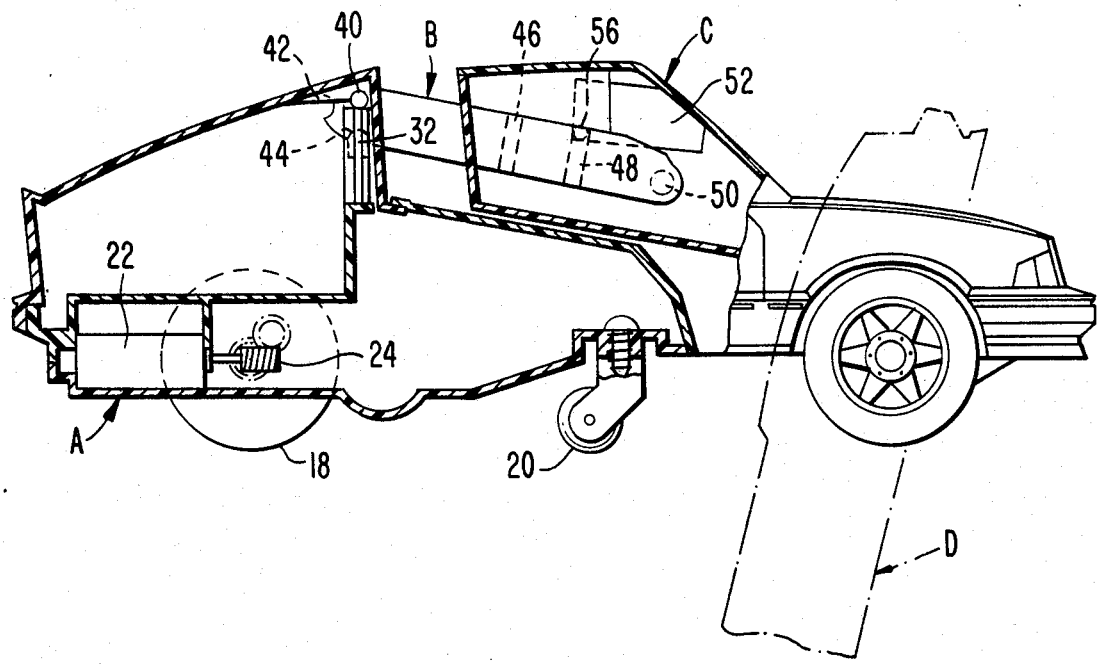
FIG. 3 is a longitudinal cross-sectional view of the toy of FIG. 1, illustrating in particular a slidably-extended position of the torso element from the leg element and one of the arm elements in phantom lines in a different rotated position from that shown in FIG. 1.
Figure 5:
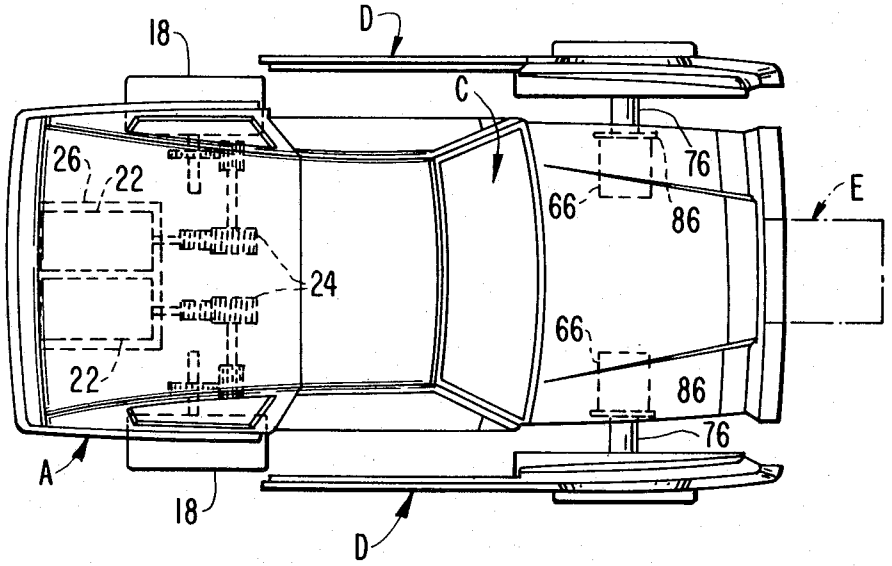
FIG. 5 is a top view of the toy of FIG. 1, illustrating in particular the arm elements slidably extended away from the torso element, the head element in phantom lines extended from the torso element, and the drive and moving means in dotted lines of the traveling element.

As embodied herein and best seen from FIGS. 1, 3 and 5, traveling element A contains inside its main body radio signal receiving unit 26 for receiving radio signals of the remote controlled radio transmitter 16 and drive and moving means for driving and moving the traveling element A in response to the radio signals received by the radio-receiving unit 26 through radio antenna 28. The drive and moving means as embodied herein for traveling element A comprises the single and freely movable travel wheel 20 centrally mounted on the lower front body portion of the traveling element A. A pair of motor driven wheels 18 are axially mounted at the rear lower body portion of the traveling element A. A pair of separately electrically actuated motors 22 are located inside the body of traveling element A for driving the respective left and right drive wheels 18 of the toy vehicle. The radio signal receiving unit 26 is electrically connected to the drive motors 22 which in turn can separately drive the respective motors 18 in accordance with the particular radio signals received through the radio signal receiving unit 26 via antenna 28 from the remote control transmitter 16. A pair of gear transmission mechanisms 24 operatively connect corresponding drive motors 22 to corresponding left and right drive wheels 18 to impart drive power to the wheels 18 when the corresponding motors 22 are activated by the radio signals. Thus, the traveling element can be moved forwardly and sideways upon actuation by the operator at the remote controlled transmitter 16 to move the toy in any preferred direction. As will now be further described, the traveling element A can be moved when the leg element B, torso element C, arm elements D, and head element E are in any of the toy's different configurational positions shown in FIGS. 1, 2 and 12.

As best seen from FIGS. 6 and 7, the leg element B of this metamorphic radio-controlled traveling toy is pivotably attached to the traveling element A such that the leg element B can be lowered and raised in relationship to the traveling element A for different configurational positions of the toy. Particularly, the leg element B has a lower base portion which is pivotably mounted to a mounting portion of the body of the traveling element A, as best seen from FIG. 6. The mounting portion of the traveling element A has the pair of guide members 34 with the guide member cavities 36 provided in face-to-face arrangement with each other on that mounting portion. A separate but integrally formed body comprising the pivotable leg mounting and connecting member 32 has a convex peripheral surface at its upper portion and the spring member 30 at its lower portion receivable into the guide cavities 36. The spring member 30 takes an arch-like shaped to provide a slight spring movement and flexibility to the pivotably leg mounting and positioning member 32.

Figure 4:
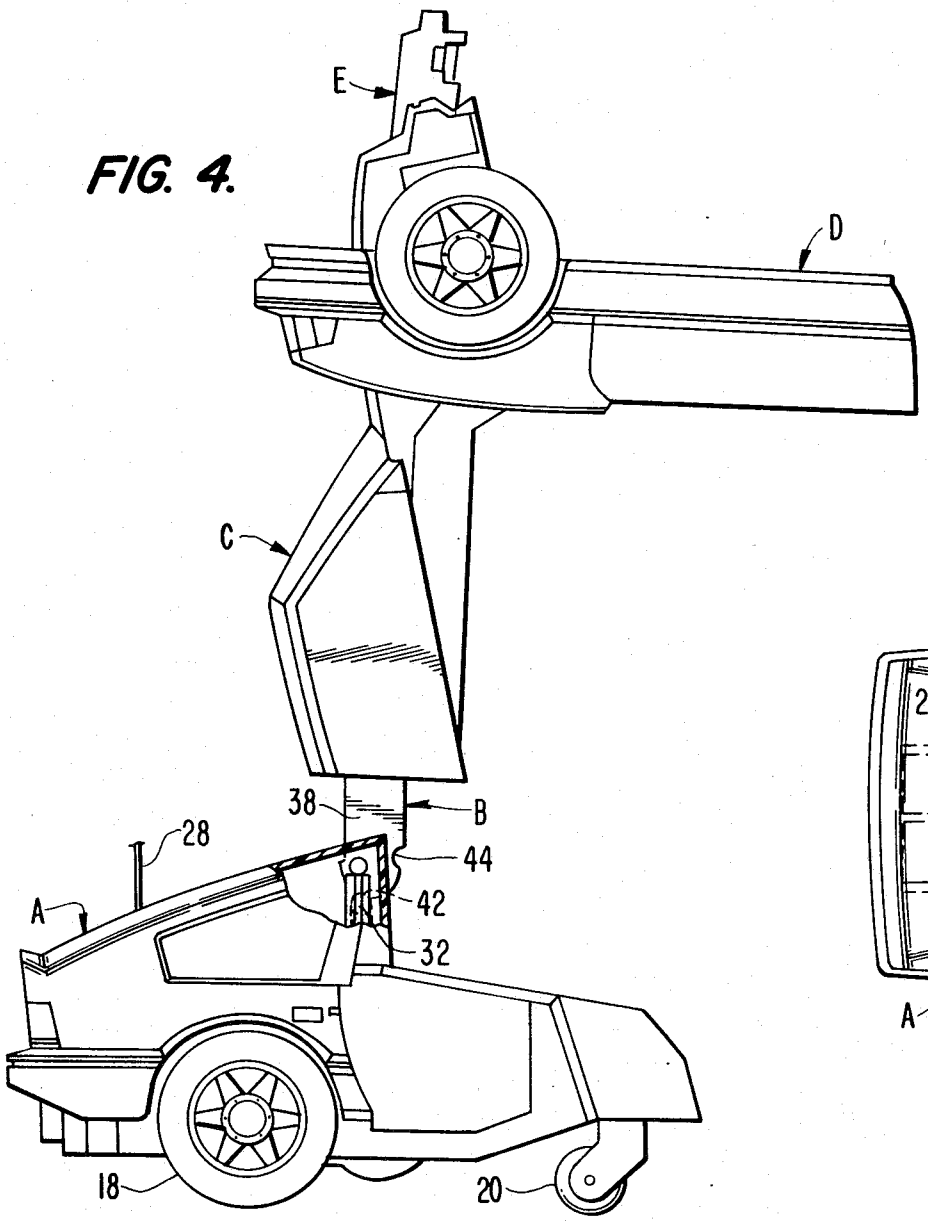
FIG. 4 is a longitudinal side view, in partial crosssection, of the toy of FIG. 1, illustrating in particular the open raised position of the head element, arm element, torso element, and leg element in relationship to the traveling element having the external configuration resembling a robot.

The leg element B is attached to the traveling element A by rotatably supporting the pivotable leg mounting axles 40 at the ends of the leg element body members 38 in the pair of corresponding pivotably leg mounting axles grooves 62 formed in an inner surface of the traveling element A. Thus, the leg element B is constructed such that it can be pivotably moved into an upwardly raised position in relationship to the traveling element A or pivotably moved downwardly to a closed lowered position in relationship to the traveling element A. The closed lowered position of the leg element B in relationship to the traveling element A is best shown in FIGS. 1 and 3, while the pivotably upwardly raised position of the leg element B in relationship to the traveling element A is best shown in FIGS. 2 and 4. The leg element B is firmly and securely positioned in either its upwardly raised or lowered positions by engagement of the first pivotably mounted leg positioning grooves 42 or the second pivotably mounted leg positioned grooves 44 formed at the lower end of the leg element body members 38 with the pivotably mounting and positioning member 32. Namely, with the first positioning grooves 42 engaged with the convex peripheral surface of the positioning member 32, the leg element B is held in a upwardly raised position to traveling element A. When the second positioning grooves 44 engage the member 32, the leg element B is held in a closed lowered position. The securing of the leg element B in these different positions is important so that the toy can be moved by the traveling element A in the toy's varied exterior configurations.

As best seen in FIG. 7, the torso element C in turn has a lower end portion slidably attached to a front upper end portion of the leg element B to make it possible to slide the torso element C in a longitudinal direction in relationship to the leg element B. More particularly, the leg element B has its front upper end portion slidable in guide ribs formed in an internal surface of the torso element C. Attached to the internal surface of the torso element C is U-shaped connecting and positioning member 52 for connecting and positioning the leg element B in relationship to the torso element C. Namely, the U-shaped member 52 is located between the pair of leg element body members 38. The U-shaped member 52 has positioning projections 56 located on the outer surface of the corresponding spring arms 54. The projections 56 can be located into either the pair of first connecting and positioning grooves 46 or in the pair of second connecting and positioning grooves 48 formed on leg element body members 38. During sliding movement of the torso element C toward leg element B, the guide roller member 50 slides along one of the guide ribs formed on the internal surface of the torso element C and engages the leg stop pin 60 to limit further longitudinal movement of the torso element C outwardly from the leg element B.

In summary, with the torso element C so constructed for sliding movement with the leg element, the traveling element A and the torso element C connected through the leg element B approach each other as best seen in FIGS. 1 and 5, while in another condition, the traveling element A and the torso element C are separated from each other through extension via the leg element B, as best shown in FIGS. 2–4. Engagement of the projections 56 of the torso element C with the corresponding engaging grooves 46 or 48 of the leg element B ensures that the torso element C is held in either the upwardly raised position with leg element B in relationship to the traveling element A or in the closed lowered position with leg element B in relationship to traveling element A. Thus, both the torso element C and leg element B are secured in the different configurational positions of the toy to ensure that when the traveling element A moves, the toy can be moved while maintaining its different exterior configurations.

The pair of arm elements D, as best seen in FIGS. 1–5 and 12, are slidably and rotatably attached to the sides of the torso element C such that the arm elements D can be moved in relationship to the torso element C for the different configurational positions of the toy. More particularly, and in accordance with one aspect of the invention, the arm elements are slidably and rotatably attached to the torso element using respective cylindrical sleeve-type mechanisms providing different stop positions of the arm element during rotational movement and for providing sliding movement of the arm elements D away from and to the sides of the torso element C. As will be seen, this type of mechanism provides smooth and easy inward and outward movement of the moveable arm element to the fixed torso element with positive rotational stop positions for the arm element in a simple sturdy mechanical connecting arrangement.

As embodied herein and as best shown with reference to FIGS. 8–10, the cylindrical sleeve-type connecting mechanism for each of the arm elements comprises components designated by reference numerals 64 through 93. The arm body member 74 generally constitutes the external configuration for the arm element D and is attached to the side of the torso element C by inserting an end of the arm axle 76 which is integrally formed to the arm body member 74 through arm axle hole 88 into the sleeve housing and support member 66 which is fixed to the inside of the torso element C. Sleeve 64 is rotatably and slidably mounted within the sleeve housing and support member 66, with the sleeve 64 being fixed to the outer end of the arm axle 76. More particularly, the fitting projection member 78 at the end of the arm axle 76 is fitted into the fitting depression 80 formed at one end of the rotatable sleeve 64. Sleeve 64 and arm axle 76 are then secured by fastening the screw member 82 into the screw hole 84 of the arm axle 76. This prevents idling between the arm axle 76 and sleeve 64.

The sleeve housing and support member 66 is fixed to the torso element using the housing and support member 90 formed on an internal surface of torso element C which receives in its mounting cavity 92 the plate-like mounting member 86 of the sleeve housing member 66. The cylindrical recesses 93 formed in the walls of housing member 90 receive the cylindrical outer walls of the sleeve housing member 66.

With the foregoing structural arrangement of the aforesaid connecting mechanism, the arm element D can be easily and smoothly slidably moved away from and toward the torso element C and can also be rotated easily and smoothly in relationship to the torso element C.

The aforesaid connecting mechanism also provides positive rotational stop positions of the arm element D. As embodied herein, the sleeve housing member 66 is provided with elastic spring-like positioning members 70, each of which is formed by a substantial U-shaped cut-out of the body of member 66 with its release portion being directed toward the plate-like mounting member 86. The elastic positioning member 70 has an engaging projection 72 near the forward end directed toward the center of the sleeve housing member 66. The sleeve 64 has a plurality of projection pass-through grooves 67 formed along the outer circumference of the sleeve 64, as best seen in FIGS. 9 and 10. At the peripheral edges of the sleeve 64, there are projection-passing cut-outs for connecting the outer ends of the projection pass-through grooves 67. At the intersections of the grooves 67 and the cut-outs 68, there are the engaging or notch recesses 69 cut slightly deeper than the grooves 67 and the cut-outs 68.

With this further structural arrangement of the connecting mechanism for the arm element D, the engaging projections 72 on the positioning member 70 may pass smoothly through the grooves 67 and the cut-outs 68 on sleeve 64 when it is desired to slidably move the arm element D away from or toward the torso element C. Moreover, the engaging projection 72 of the positioning member 70 are smoothly and reliably engageable with the rotary positioning and engaging notches 69 because of the deeper engaging recesses 69 formed at the intersection of the grooves 67 and the cut-outs 68. While the preferred embodiment described herein uses a pair of positioning members 70, it can be seen that the number and arrangement of the elastic elements 70 can be optionally selected along with the number of the pass-through grooves 67 and the like. Since the positioning member 70 is so formed that it connects with the deeper recess 69, it is possible to hold positively a condition in which the arm element D approaches the torso element C and also another condition in which the arm element D separates from the torso element C while also holding positively the arm element D at a predetermined rotational angle thereof.

Operation of the aforesaid connecting mechanism according to the invention will now be further described. When the moveable member, or the arm element D, is connected to the fixed member, or torso element C, the engaging projections 72 of the sleeve receiving housing member 66 are engaged with corresponding engaging recesses or notches 69 of the sleeve 64 located adjacent to the moveable arm D. By pulling the moveable arm element D axially relative to the arm axle 76 so as to be moved away from the torso element C, the engaging recesses 69 are disengaged from the engaging projections 72 and the elastic members 70 are deflected outwardly thereby allowing the projections 72 to pass through the projection-passing grooves 67. The other engaging recesses 69 away from the moveable arm D then become engaged with the projections 72 when that end of the sleeve 64 closest to the arm body 74 contacts the inner wall of the fitting plate-like member 86. Forceable rotation of the arm element D by a user allows the engaging projections 72 which have been disengaged from a pair of engaging recesses 69 on the opposite side to arm body 74 to pass through the projection-passing cut-out 68 to engage with other engaging recesses 69 and thereby retain the moveable arm element D in another yet different rotary stop position. In order to approach the moveable arm element D to the fixed torso element C, the arm element D may be forceably pushed axially relative to the arm axle 20.

With the foregoing structural arrangement and operation of the connecting mechanism of this invention, sliding and rotating movement of the arm element D are easily and smoothly facilitated and the rotary stop positions of the arm element D at a given angle are surely retained upon removing or inserting the element D to and from the element C. Further, this connecting mechanism is strong and durable so that it can withstand rough handling by children and other users. In addition, this connecting mechanism may be readily mounted to any moveable point and thereby be very versatile and economical to fit different types of metamorphic toys. The elastic members may be inexpensively and easily formed by the substantially U-shaped cut-out on the circumference of the sleeve receiving member 66 and easily allows the engaging projections 72 to pass through the projection-passing grooves and cut-outs by its own elastic force to be engaged and disengaged with the engaging recesses 69. The engaging recesses 69 are formed more deeply than the grooves 67 and the cut-outs 68 so that the projections 72 may be engaged therewith more securely and thus the stop positions of the moveable arm element D reliably retained. The rotatable sleeve 66 is provided with fitting depression 80 fitted to the fitting projection 78 arranged at the end of the arm axle 76 so that the idling between the sleeve 66 and the arm axle 76 may be prevented and the sleeve 66 may be forceably rotated against the elastic force of the elastic positioning member 70. Finally, the plate-like mounting member 86 allows for easy assembly and insertion of the connecting mechanism into the housing and support member 90 on the torso element C.

In summary, sliding and rotating movement of the arm element C is smooth and the stopping positions of the arm element C at the required positions are reliably retained. Moreover, the connecting mechanism is strong and resistant to malfunction, is simple in structure and is suitable for mass production due to its low cost. The connecting mechanism is also very versatile and thus has practical advantages for different types of toys which require moveable body elements to fixed elements.

The head element E of the toy, as shown in FIGS. 2, 4, 5 and 11, is slidably attached to the torso element C so that the head element E can be moved into the torso element C and extended from the torso element for different configurational positions of the toy. Therefore, the toy may be changed freely from its shape of an automobile, as shown in FIG. 1, to a robot-like shape as shown in FIG. 2. As embodied herein and as best seen in FIG. 11, the head element E comprises the integral U-shaped body member 94 having the front portion 96 forming the head of element E and the second spring-like arms 98 mounted inside the torso element C. The U-shaped body member 94 is slidably mounted on the inside surface of the torso element, wherein the spring-like arms 98 of member 94 slide within guide ribs 102 of torso element C. By a user exerting force on head portion 96, the pair of projections 100 formed on the outer surface of the arms 98 of body member 94 either engage the corresponding pair of first positioning grooves 104 or second positioning grooves 106 to respectively provide a position location for the head element E away from the torso element C or into the torso element C. With this type of connecting and positioning mechanism, the location of the head element E is assured during traveling movement of the toy in its different configurational positions.

To summarize the general operation of this metamorphic traveling toy as described fully above, or to change the shape of the traveling toy from the automobile vehicle configuration to the robot-like configuration, the traveling element A and the torso element C are separated along a longitudinal direction by pulling the leg element B and torso element C in opposite directions (see, e.g., FIG. 3). Thereby, the projections 56 of U-shaped connecting and positioning member 52 engaging the first connecting and positioning grooves 46 are released and connected to the pair of second connecting and positioning grooves 48, thereby assuring separation of the traveling element A from the torso element C. When the leg element B and the torso element C are swung together upward on the pivoting and mounting axles 40 of leg element B, the connecting and positioning grooves 44 move away from the positioning member 32 and the connecting and positioning grooves 42 then engage the positioning member 32. Thereby, an upright position to the leg and torso elements are assured. Next, when the arm element D is pulled away from the torso element C to separate it from the latter, the projections 72 pass through grooves 67, whereby the condition in which the arm element D is separated from the torso element C is securely held. Further, when the arm element D is rotated about the arm axle 76, the rotational positions at an appropriate rotational angle of the arm element D are firmly held by the engagement of the projections 72 with the corresponding engaging recesses 69. Finally, when the head element E is pulled out from the torso element C, the positioning projections 100 engage the pair of first positioning grooves 104 to thus securely fix the head element E away out from the torso element C.

In order to change the shape of the toy from the robot-like configuration to the automobile configuration, the reverse of the aforesaid operation is applicable.

In view of the foregoing detailed description of the structural arrangement and operation of the preferred embodiments, the toy in accordance with this invention provides for a unique metamorphic radio-controlled traveling toy having a wide variety of exterior configurations, thus capturing the appeal and interest of the users. Moreover, this toy can be easily and smoothly operated in all of its different configurational positions and wherein the shape-changing actions can be performed easily and smoothly by the user between the varied configurational positions of the toy. In addition, the toy is durable, and simple in operation and in mechanical structure and electrical arrangement to provide a relatively inexpensive manufactured toy having such unique effects.

It will be apparent to those skilled in the art from reading the description of this invention that modifications and variations could be made in the toy in accordance with the teachings of the invention without departing from the spirit or scope thereof. Thus, it is intended that the present invention cover the modifications and variations of this invention within the scope of the appended claims and their equivalents.

What I claim is:

1. A metamorphic radio-controlled traveling toy comprising:

(a) a traveling element, including a radio signal receiving unit for receiving control signals from a remote radio control transmitter and drive and moving means for driving and moving the toy in response to the radio signals received by said radio receiving unit;

(b) a leg element pivotably attached to the traveling element such that the leg element can be lowered and raised in relationship to the traveling element for different configurational positions of the toy;

(c) a torso element slidably attached to the leg element such that the torso element can be moved in relationship to the leg element for different configurational positions of the toy;

(d) an arm element slidably and rotatably attached to the torso element such that the arm element can be moved in relationship to the torso element for different configurational positions of the toy; and (e) a head element slidably attached to the torso element such that the head element can be moved into the torso element and extended from the torso element for different configurational positions of the toy.

2. The toy of claim 1, wherein said arm element comprises a first arm element connected to one side of said torso element and the toy further comprising a second arm element connected to another side of said torso element.

3. The toy of claim 2, wherein the traveling, leg, torso, arm and head elements form the exterior configuration of a toy vehicle in one configurational position, while in another configurational position, said traveling, leg, torso, arm and head elements form the exterior configuration of a robot.

4. The toy of claim 1, wherein said traveling, leg, torso, arm and head elements are moveably attached to the respective elements such that there is no separation of the elements when changing between the external toy configurations.

5. The toy of claim 1, wherein the traveling element is moveable in the different configurational positions of the leg element, torso element, arm element and head element.

6. The toy of claim 1, further comprising connecting and positioning means for pivotably mounting the leg element to the traveling element and for securing the leg element in a lowered position to the traveling element and in a raised position to the traveling element.

7. The toy of claim 1, further comprising connecting and positioning means for slidably mounting the torso element for movement in a longitudinal direction to the leg element and for securing the torso element in a longitudinally extended direction and in a longitudinally closed direction to the leg element.

8. The toy of claim 1, further comprising connecting and positioning means for slidably connecting the head element to the torso element for movement of the head element into the torso element and outward from the torso element and for securing the head element in its outward position and in its inward position in relationship to the torso element.

9. The toy of claim 1, further comprising connecting and positioning means for connecting the arm element to the torso element for movement of the arm element to and away from and rotationally with respect to the torso element and for securing the arm element in different rotational positions to the torso element.

10. The toy of claim 9, wherein the connecting and positioning means for the arm element to the torso element comprises a substantially cylindrical sleeve housing and support member fixed to the torso element, a sleeve slidably and rotatably received in the sleeve housing and support member, and a shaft extending from the arm element and connected to one end of the rotatable and slidable sleeve.

11. The toy of claim 10, wherein said connecting and positioning means for the arm element to the torso element comprises spring-like positioning members formed on the sleeve housing and support member, the spring-like positioning members having engaging projections extending inwardly of the sleeve housing and support member, and projection pass-through grooves formed on the outer circumference of the sleeve, wherein the engaging projections pass through the grooves when the arm element is actuated and moved inwardly or outwardly from the torso element.

12. The toy of claim 11, wherein said connecting and positioning means for the arm element to the torso element comprises projection pass-through cut-outs formed along the peripheral edges of the sleeve, wherein the engaging projections pass through the cut-outs when the arm element is actuated and rotationally moved from one rotational position to another, and engaging recesses formed at the peripheral edges of the sleeve at the intersection of the projection pass-through cut-out and ends of the projection pass-through grooves, wherein the engaging projections engage respective engaging recesses in accordance with the rotational position and slidable position of the arm element to the torso element.

13. A connecting device for connecting a moveable element to a fixed element in a metamorphic toy comprising:

(a) a fixed body;

(b) a moveable body having an arm shaft;

(c) a piece-receiving means having a substantially cylindrical piece-receiving housing for receiving a cylindrical-shaped piece slidably and rotatably, said piece-receiving means being mounted to the fixed body and having elastic elements, each elastic element being formed by a substantially U-shaped cut-out in the circumference wall of the cylindrical housing and having an engaging projection directed toward a center of the piece-receiving cylindrical housing; and (d) a substantially cylindrical-shaped piece having one end fixed to an end of the arm shaft of the moveable body, and having a plurality of projection pass-through grooves transversely along the outer cylindrical circumference of the piece for allowing said engaging projections of said elastic elements to pass therethrough, projection pass-through cut-outs at the peripheral edges of the piece for connecting end portions of the projection pass-through grooves, and engaging recesses formed at the intersections of the ends of said grooves and cut-outs deeper than said grooves and said cutouts, said recesses being engageable and disengageable with said engaging projections of said elastic elements in accordance with the rotational position and slidable position of the moveable body to the fixed body.

* * * * *